US005953837A

United States Patent [19]

Clifford

[11] Patent Number: 5,953,837

[45] Date of Patent: Sep. 21, 1999

[54] SNOW REMOVAL AND DISPOSAL VEHICLE

[76] Inventor: Mark F. Clifford, 922 Garfield Ave., Lansdale, Pa. 19446

[21] Appl. No.: 09/174,627

[22] Filed: Oct. 19, 1998

[51] Int. Cl.[6] ..... E01H 5/10

[52] U.S. Cl. ..... 37/228; 37/223; 37/248; 37/255; 126/343.5 R

[58] Field of Search ..... 37/227, 222, 223, 37/229, 244, 248, 249, 250, 255, 228; 126/343.5 R

[56] References Cited

U.S. PATENT DOCUMENTS

| | | | |
|---|---|---|---|
| 2,893,377 | 7/1959 | Janousek | 37/227 |
| 2,977,955 | 4/1961 | Altenburg | 37/227 |
| 3,066,428 | 12/1962 | Raiti | 37/250 |
| 3,106,792 | 10/1963 | Park | 37/250 |
| 3,353,286 | 11/1967 | Marks | 37/250 |
| 3,404,470 | 10/1968 | Raiti | 37/227 |
| 4,164,820 | 8/1979 | Krickovich | 37/229 |
| 5,365,681 | 11/1994 | Miranda | 37/227 |

*Primary Examiner*—Thomas B. Will
*Assistant Examiner*—Kristine M. Markovich

[57] ABSTRACT

A cylindrical tank is situated on a bed of a vehicle. A tank opening is provided at a top of the tank. An agitator is provided within the tank. A heating unit such as an oil fired boiler, comprises a burner unit situated on the bed, and fire tube heating elements which longitudinally span an interior surface of the tank. Drain outlets are provided in a bottom of the tank. Discharge tubes run from the drain outlets to discharge outlets beneath the tank. Drain hoses may be connected to the discharge outlets and routed to an appropriate drainage location. A plow blade apparatus is connected to a front of the cab. The plow blade apparatus is generally trough shaped and includes a first Archimedean screw disposed longitudinally therein. An inclined trough has a low end thereof disposed next to the plow blade apparatus. The inclined trough spans from the plow blade apparatus to a high end above the tank. The inclined trough contains a second Archimedean screw disposed longitudinally therein. A mechanical arm translates a high section of the inclined trough toward and away from the tank. When the high section is completely translated toward the tank, the high end of the inclined trough is above the tank opening.

4 Claims, 2 Drawing Sheets

SNOW REMOVAL AND DISPOSAL VEHICLE

BACKGROUND OF THE INVENTION

1. Field of the Invention

The present invention relates to vehicles having apparatus for removing, melting and disposing of snow from roadways, parking lots and the like.

2. Description of the Related Art

Although the prior art includes other vehicles having apparatus for removing, melting and disposing of snow from roadways, parking lots and the like, none have been developed which have the options, simplified construction and efficiency of the present invention.

SUMMARY OF THE INVENTION

The snow removal and disposal vehicle of the present invention includes a cab and a bed. Situated on the bed is a cylindrical tank. A tank opening is provided at a top of the tank. An agitator is provided within the tank. A heating unit such as an oil fired boiler, comprises a burner unit situated on the bed, and fire tube heating elements which longitudinally span an interior surface of the tank.

Drain outlets are provided in a bottom of the tank. Discharge tubes run from the drain outlets to discharge outlets beneath the tank. Drain hoses may be connected to the discharge outlets and routed to an appropriate drainage location.

A plow blade apparatus is connected to a front of the cab. The plow blade apparatus is generally trough shaped and includes a first Archimedean screw disposed longitudinally therein.

An inclined trough has a low end which is next to the plow blade apparatus. The inclined trough spans from the plow blade apparatus to a high end above the tank. The inclined trough contains a second Archimedean screw disposed longitudinally therein.

As the vehicle moves forward along a snow covered road, snow is collected within the plow blade, and is translated by the first Archimedean screw to the inclined trough and the second Archimedean screw. The second Archimedean screw translates the snow toward the high end, where the snow is discharged off of the inclined trough.

A mechanical arm translates a high section of the inclined trough toward and away from the tank. When the high section is completely translated toward the tank, the high end of the inclined trough is above the tank opening. The snow discharged from the trough at the high end is discharged into the tank through the tank opening, when the high end is above the tank. The snow is alternatively discharged to the side of the road when the high section is translated away from the tank.

When the snow falls into the tank, the spinning agitator throws the snow outward toward the heating elements at the wall of the tank. The barriers help to break up larger, more solid clumps of snow. Melted snow flows to the bottom of the tank and flows out of the tank through the drain outlets.

Further features and advantages will become apparent from the ensuing description and drawings.

DETAILED DESCRIPTION

Figure 1:
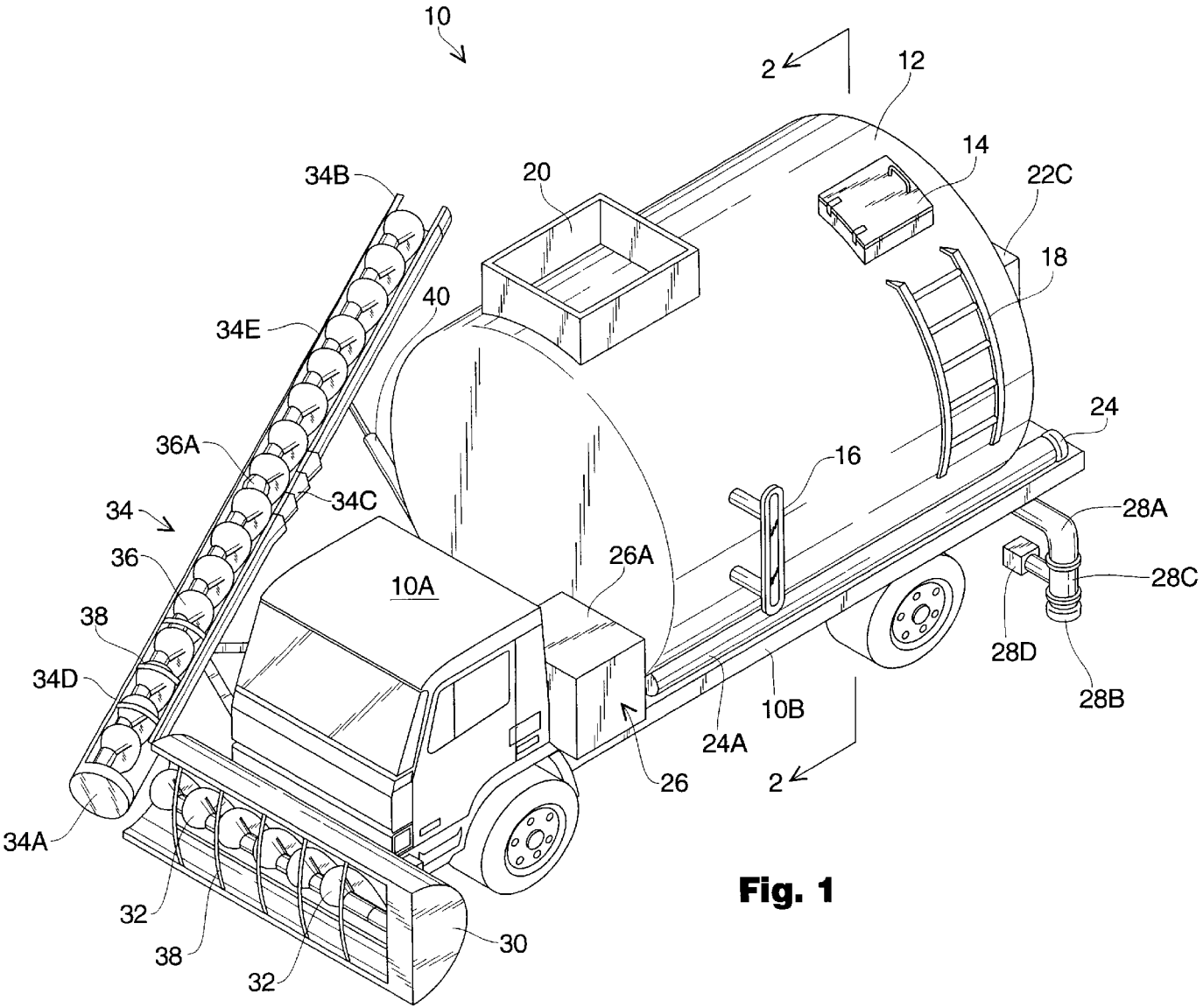
FIG. 1 is a perspective view of a snow removal and disposal vehicle of the present invention.
Figure 2:
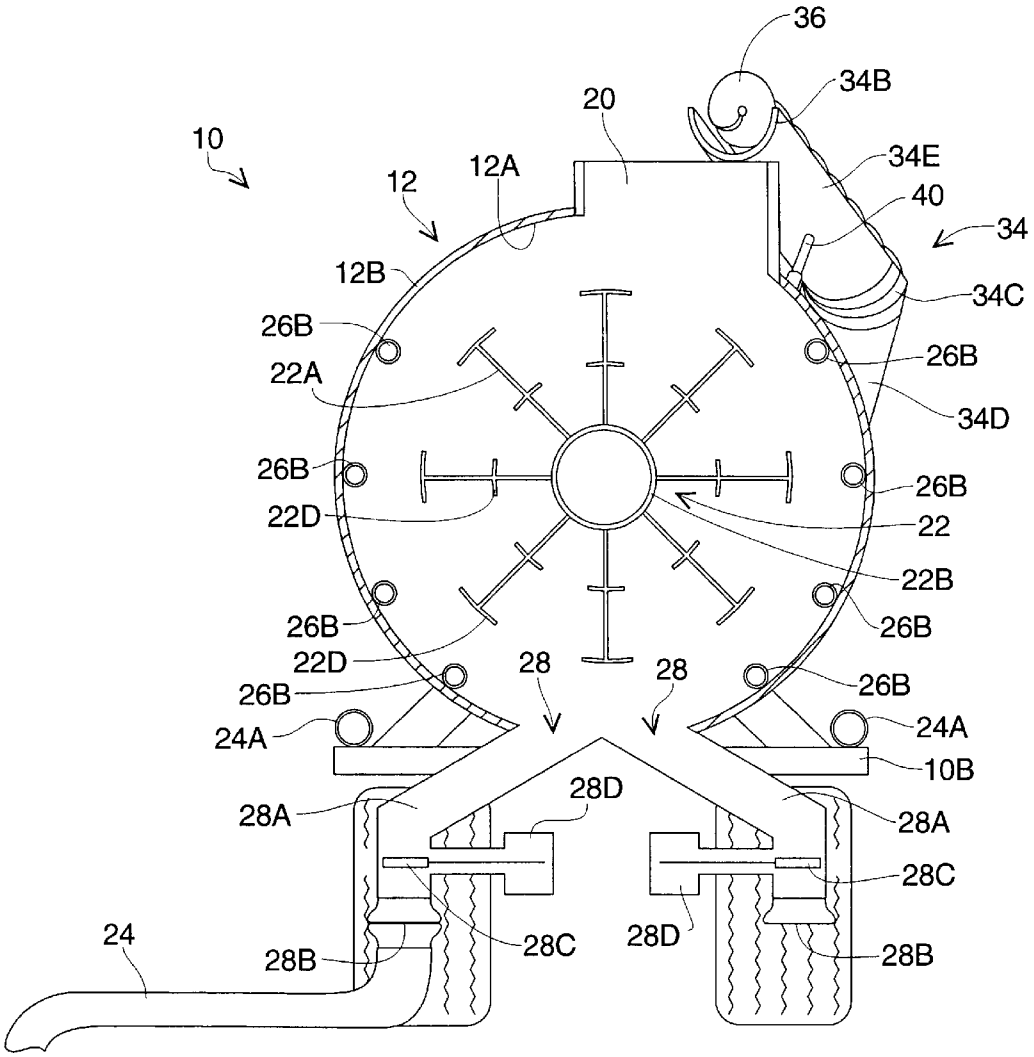
FIG. 2 is a cross-sectional view of the snow removal and disposal vehicle, taken along line 2—2 of FIG. 1.

FIG. 1 is a perspective view of a snow removal and disposal vehicle 10 of the present invention. FIG. 2 is a cross-sectional view of the snow removal and disposal vehicle 10, taken along line 2—2 of FIG. 1. Referring to the figures, the vehicle 10 includes a cab 10A and a bed 10B. Situated on the bed 10B is a tank 12. An inspection and clean out hatch 14 is provided on the tank 12. A water level indicator 16 and an access ladder 18 to the hatch 14 are provided on a side of the tank 12. A tank opening 20 is provided at a top of the tank 12. Drain hoses 24 are stored on the bed 10B in sleeves 24A, generally beside and below the tank 12.

The tank 12 is generally cylindrical. An agitator 22 having paddles 22A radially disposed on a hub 22B and driven by an agitator motor 22C is provided within the tank 12. The motor 22C is situated at the rear of the tank 12. Barriers 22D extend outwardly from the paddles 22A, generally perpendicularly thereto. The agitator 22 is disposed longitudinally within the tank 12. A longitudinal central axis of the agitator 22 is generally collinear with a central axis of the tank 12. The barriers 22D and the paddles 22A are generally planar in a direction parallel to the longitudinal central axis of the agitator 22. The barriers 22D and the paddles 22A are generally 4 inches wide measured along the longitudinal central axis of the agitator 22, and are spaced generally 4 feet on center, measured along the longitudinal central axis of the agitator 22. Other suitable dimensions are within the scope of the present invention.

A heating unit 26 comprises a burner unit 26A situated on the bed 10B adjacent the tank 12, and fire tube heating elements 26B which longitudinally span an interior surface 12 A of a wall 12B of the tank 12.

Drain outlets 28 are provided in a bottom of the tank 12. Discharge tubes 28A run from the drain outlets 28 to discharge outlets 28B beneath the tank 12. Shutoff valves 28C are provided in the discharge tubes 28A. The shutoff valves 28C have manual or motorized operators 28D.

The drain hoses 24 may be connected to the discharge outlets 28B and routed to an appropriate drainage location such as a storm sewer inlet (not shown).

A plow blade apparatus 30 is connected to a front of the cab 10A and spans horizontally in front of the cab 10A. The plow blade apparatus 30 is generally trough shaped and includes a first Archimedean screw 32 disposed longitudinally therein.

An inclined trough 34 has a low end 34A thereof positioned next to the plow blade apparatus 30. The inclined trough 34 spans from the plow blade apparatus 30 to a high end 34B above the tank 12. The inclined trough 34 contains a second Archimedean screw 36 disposed longitudinally therein. The plow blade apparatus 30 and the inclined trough 34 both include safety bars 38 on the faces thereof.

As the vehicle 10 moves forward along a snow covered road (not shown), snow (not shown) is collected within the plow blade 30, and is translated by the first Archimedean screw 32 to the inclined trough 34 and the second Archimedean screw 36. The second Archimedean screw 36 translates the snow toward the high end 34B, where the snow is discharged off of the inclined trough 34. The first and second Archimedean screws 32, 36 are driven by separate motors (not shown).

The inclined trough 34 includes a flexible joint 34C disposed between the low end 34A and the high end 34B. The flexible joint 34C is configured in a known manner, such as by sliding plates as shown in the figures. The inclined trough 34 is divided by the flexible joint 34C into a low section 34D and a high section 34E. A universal joint 36A is disposed on the second Archimedean screw 36, permitting the second Archimedean screw and the inclined trough 34 to flex together.

A hydraulically operated mechanical arm 40 is connected to the tank 12 and to the inclined trough 34. The arm 40 translates the high section 34E toward and away from the tank 12. When the high section 34E is completely translated toward the tank 12, the high end 34B of the inclined trough 34 is above the tank opening 20. The snow discharged from the trough 34 at the high end 34B is discharged into the tank 12 through the tank opening 20, when the high end 34B is above the tank 20. The snow is alternatively discharged to the side of the road (not shown) when the high section 34E is translated away from the tank 12.

When the snow (not shown) falls into the tank 12 through the tank opening 20, the spinning agitator 22 throws the snow outward along the paddles 22A toward the heating elements 26B at the wall 12B of the tank 12. The barriers 22D help to break up larger, more solid clumps of snow. Melted snow flows to the bottom of the tank 12 and flows out of the tank 12 through the drain outlets 28.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A snow removal and disposal vehicle comprising:

a. a cab;

b. a tank positioned behind the cab;

c. a tank opening provided generally at a top of the tank, adapted to receive snow there-through;

d. a heating unit comprising heating elements within the tank;

e. a generally trough shaped plow blade apparatus spanning generally horizontally in front of the cab;

f. the plow blade apparatus containing a first snow translation means disposed longitudinally therein;

g. an inclined trough having a low end positioned proximate an end of the plow blade apparatus, the inclined trough spanning from the low end to a high end;

h. the inclined trough containing a second snow translation means disposed longitudinally therein;

i. the first snow translation means adapted to translate snow collected by the plow blade apparatus to the low end of the inclined trough and the second snow translation means;

j. the second snow translation means adapted to translate snow from the low end of the inclined trough to the high end of the inclined trough, and to discharge snow off of the inclined trough from the high end;

k. a mechanical arm configured to translate the high end of the inclined trough toward the tank to a position wherein the high end of the inclined trough is above the tank opening, and to translate the high end of the inclined trough away from the tank, wherein the second snow translation means is adapted to discharge snow from the high end of the inclined trough to the tank opening and alternatively to a location away from the tank.

2. A snow removal and disposal vehicle comprising:

a. a cab;

b. a tank positioned generally behind the cab;

c. a tank opening provided on the tank, adapted to receive snow there-through;

d. a heating unit comprising at least one heating element configured to heat at least a portion of a wall of the tank;

e. an agitator positioned within the tank;

f. the agitator comprising a hub, paddles extending radially from the hub, and barriers extending outwardly from the paddles;

g. the agitator adapted to throw snow against the wall of the tank when the agitator spins, the barriers adapted to break up clumps of snow as the clumps are thrown along the paddles toward the wall;

h. a plow blade apparatus positioned in front of the cab;

i. an inclined snow conveyance structure having a low end positioned proximate an end of the plow blade apparatus, the inclined trough spanning from the low end to a high end;

j. the inclined snow conveyance structure containing a second snow translation means disposed longitudinally therein;

k. a first snow translation means for translating snow collected by the plow blade apparatus to the low end of the inclined snow conveyance structure and the second snow translation means; and l. the second snow translation means adapted to translate snow from the low end of the inclined snow conveyance structure to the high end of the inclined snow conveyance structure, and to discharge snow off of the inclined snow conveyance structure from the high end.

3. The snow removal and disposal vehicle of claim 2, wherein:

a. the tank is positioned behind the cab;

b. the tank opening is provided generally at the top of the tank;

c. the at least one heating element is a plurality of heating elements extending along an interior surface of the wall of the tank;

d. the plow blade apparatus is generally trough shaped and spans generally horizontally in front of the cab;

e. the first snow translation means is a first Archimedean screw disposed longitudinally within the plow blade apparatus;

f the snow conveyance structure is a trough;

g. the second snow translations means is a second Archimedean screw;

h. the snow removal and disposal vehicle further comprises:

i. a flexible joint in the inclined snow conveyance structure between the low end and the high end, the flexible joint dividing the inclined snow conveyance structure into a low section and a high section;

ii. a universal joint in the second snow translation means proximate the flexible joint; and iii. a mechanical arm configured to translate the high section of the inclined snow conveyance structure toward the tank to a position wherein the high end of the inclined snow conveyance structure is above the tank opening, and to translate the high section of the inclined snow conveyance structure away from the tank, wherein the second snow translation means is adapted to discharge snow from the high end of the inclined snow conveyance structure to the tank opening and alternatively to a location away from the tank.

4. A snow removal and disposal vehicle comprising:

a cab;

b. a tank positioned generally behind the cab;

c. a tank opening provided on the tank, adapted to receive snow there-through;

d. a heating unit comprising at least one heating element adapted to heat snow within the tank;

e. a plow blade apparatus positioned in front of the cab;

f. an inclined snow conveyance structure having a low end positioned proximate an end of the plow blade apparatus, the inclined snow conveyance structure spanning from the low end to a high end;

h. the inclined snow conveyance structure containing a second snow translation means disposed longitudinally therein;

i. a first snow translation means adapted to translate snow collected by the plow blade apparatus to the low end of the inclined snow conveyance structure and the second snow translation means;

j. the second snow translation means adapted to translate snow from the low end of the inclined snow conveyance structure to the high end of the inclined snow conveyance structure, and to discharge snow off of the inclined snow conveyance structure trough from the high end;

k. a mechanical device configured to translate the high end of the inclined snow conveyance structure toward the tank to a position wherein the high end of the inclined snow conveyance structure is above the tank opening, and to translate the high end of the inclined snow conveyance structure away from the tank, wherein the second snow translation means is adapted to discharge snow from the high end of the inclined snow conveyance structure to the tank opening and alternatively to a location away from the tank.

* * * * *